US008602228B1

(12) United States Patent
Martinez

(10) Patent No.: US 8,602,228 B1
(45) Date of Patent: Dec. 10, 2013

(54) COMPACTABLE WALL MOUNTED STORAGE ASSEMBLY

(76) Inventor: Jaymie M. Martinez, Aurora, CO (US)

( * ) Notice: Subject to any disclaimer, the term of this patent is extended or adjusted under 35 U.S.C. 154(b) by 94 days.

(21) Appl. No.: 13/314,861

(22) Filed: Dec. 8, 2011

(51) Int. Cl.

| | |
|---|---|
| ***D06F 57/12*** | (2006.01) |
| ***A47K 10/04*** | (2006.01) |
| ***A47F 7/19*** | (2006.01) |
| ***A47F 7/08*** | (2006.01) |
| ***A47G 25/06*** | (2006.01) |

(52) U.S. Cl.
USPC ..... 211/100; 211/99; 211/171; 211/38; 211/106.01

(58) Field of Classification Search
USPC ..... 211/96, 97, 98, 99, 100, 101, 102, 106, 211/106.01, 119.004, 171, 87.01, 175, 193, 211/34, 38, 181.1, 119, 113, 94.01, 168; 248/302, 303, 304, 214, 215, 218.1, 248/309.1, 316.1, 316.7, 316.8
See application file for complete search history.

(56) References Cited

U.S. PATENT DOCUMENTS

| | | | | |
|---|---|---|---|---|
| 609,116 | A * | 8/1898 | McDonald | 211/100 |
| 840,512 | A * | 1/1907 | Palmer | 211/99 |
| 1,270,156 | A * | 6/1918 | Henderson | 211/170 |
| 1,435,183 | A * | 11/1922 | Shepherd | 211/99 |
| 1,496,739 | A * | 6/1924 | Ranson | 211/100 |
| 1,497,209 | A * | 6/1924 | Chapman | 211/100 |
| 1,530,407 | A * | 3/1925 | Ranson | 211/100 |
| 1,626,399 | A | 4/1927 | Fischer | |
| 2,018,395 | A | 10/1935 | Bower | |
| 2,217,795 | A * | 10/1940 | Dawson et al. | 211/100 |
| 2,311,932 | A * | 2/1943 | Deckard | 211/70.4 |
| 2,463,748 | A * | 3/1949 | Connors | 211/100 |
| 2,508,938 | A * | 5/1950 | Derr | 211/100 |
| 2,561,728 | A * | 7/1951 | Dolan | 211/89.01 |
| 2,632,571 | A * | 3/1953 | Kendis | 211/100 |
| 2,734,639 | A * | 2/1956 | Green | 211/96 |
| 2,797,817 | A * | 7/1957 | Shugarman | 211/96 |
| 3,211,295 | A * | 10/1965 | Philip | 211/100 |
| 3,490,600 | A * | 1/1970 | Reed et al. | 248/220.41 |
| 3,527,354 | A * | 9/1970 | Sokolow | 211/70.5 |
| 3,797,670 | A * | 3/1974 | Lavemour | 211/94.03 |
| 3,978,612 | A * | 9/1976 | Young | 47/40 |
| 4,109,794 | A * | 8/1978 | Samuel et al. | 211/85.3 |
| 4,126,231 | A * | 11/1978 | Derwent-Wryde | 211/99 |
| 4,131,259 | A * | 12/1978 | Franks | 248/311.2 |
| 4,289,243 | A * | 9/1981 | Arbuzoff | 211/35 |
| 4,360,109 | A * | 11/1982 | Kurtz | 211/100 |
| 4,485,928 | A | 12/1984 | Staashelm | |
| 4,779,743 | A | 10/1988 | McKinnon | |
| 4,856,661 | A * | 8/1989 | Guillen et al. | 211/100 |
| 4,972,961 | A * | 11/1990 | Roesch | 211/116 |
| 5,054,628 | A * | 10/1991 | Allen | 211/104 |
| 5,076,442 | A | 12/1991 | Hakeem | |
| 5,165,555 | A * | 11/1992 | Anatalio | 211/96 |
| 5,567,029 | A * | 10/1996 | Haenisch et al. | 312/405.1 |
| 6,390,308 | B1 * | 5/2002 | Ebrahim | 211/85.3 |
| 7,445,127 | B2 | 11/2008 | Pittman | |
| D584,940 | S | 1/2009 | Joss et al. | |
| 7,806,280 | B1 * | 10/2010 | Perkins et al. | 211/100 |
| 2007/0068887 | A1 * | 3/2007 | Nawrocki | 211/70.6 |

* cited by examiner

*Primary Examiner* — Jennifer E Novosad

(57) ABSTRACT

A compactable wall mounted storage assembly is provided for organizing and storing items in a position elevated off of a floor surface. The assembly includes a mounting plate configured for being coupled to a support surface. A plurality of arms is pivotally coupled to the mounting plate. Each arm is pivotable into a retracted position parallel to the mounting plate and further pivotable to extend outwardly from the mounting plate. A plurality of clips is provided with each clip being coupled to an associated one of the arms proximate a distal end of the associated arm relative to the mounting plate.

6 Claims, 3 Drawing Sheets

COMPACTABLE WALL MOUNTED STORAGE ASSEMBLY

BACKGROUND OF THE DISCLOSURE

1. Field of the Disclosure

The disclosure relates to storage devices and more particularly pertains to a new storage device for organizing and storing items in a position elevated off of a floor surface.

2. Summary of the Disclosure

An embodiment of the disclosure meets the needs presented above by generally comprising a mounting plate configured for being coupled to a support surface. A plurality of arms is pivotally coupled to the mounting plate. Each arm is pivotable into a retracted position parallel to the mounting plate and further pivotable to extend outwardly from the mounting plate. A plurality of clips is provided with each clip being coupled to an associated one of the arms proximate a distal end of the associated arm relative to the mounting plate.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
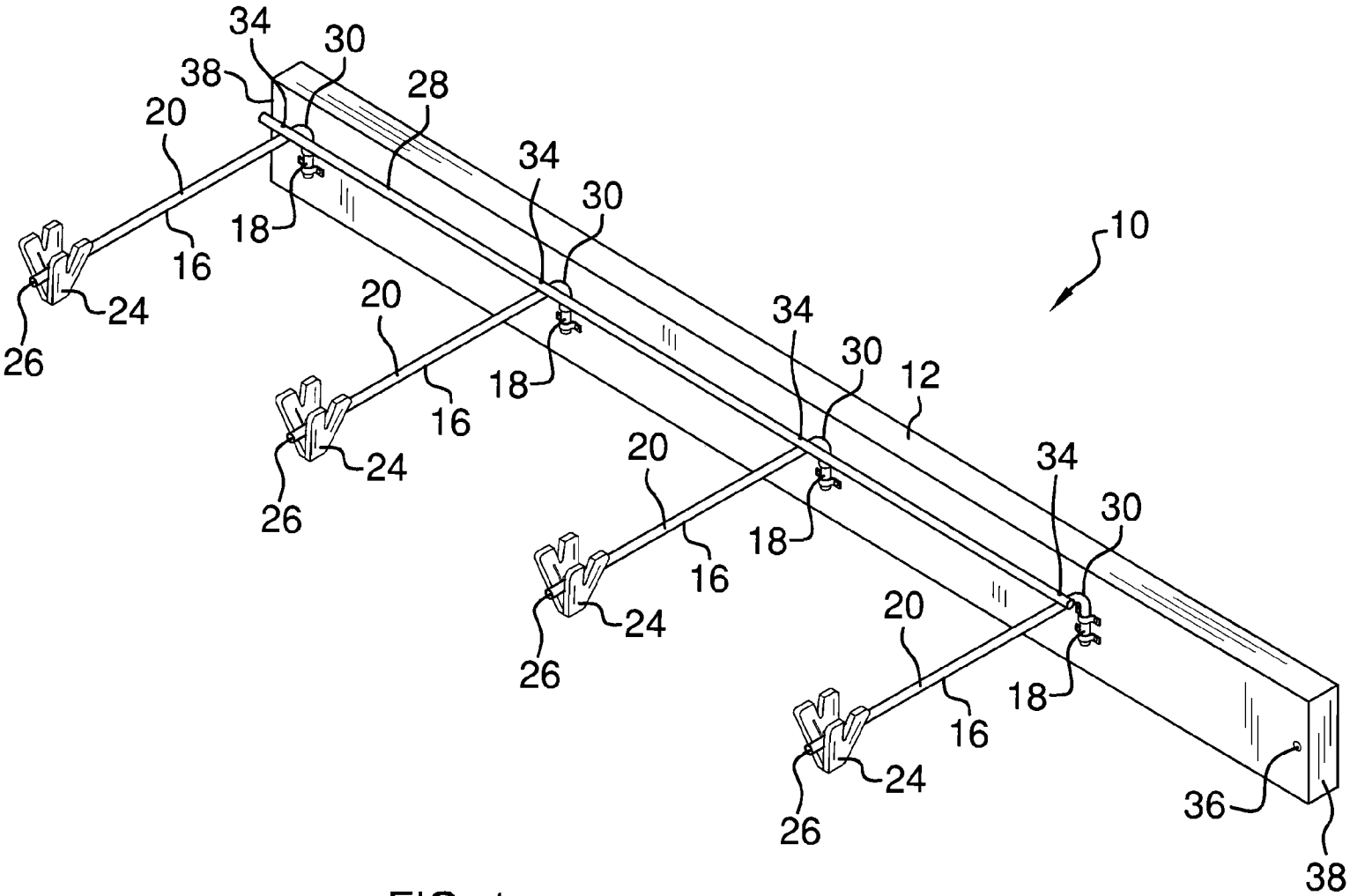
FIG. 1 is a top front side perspective view of a compactable wall mounted storage assembly according to an embodiment of the disclosure.
Figure 2:
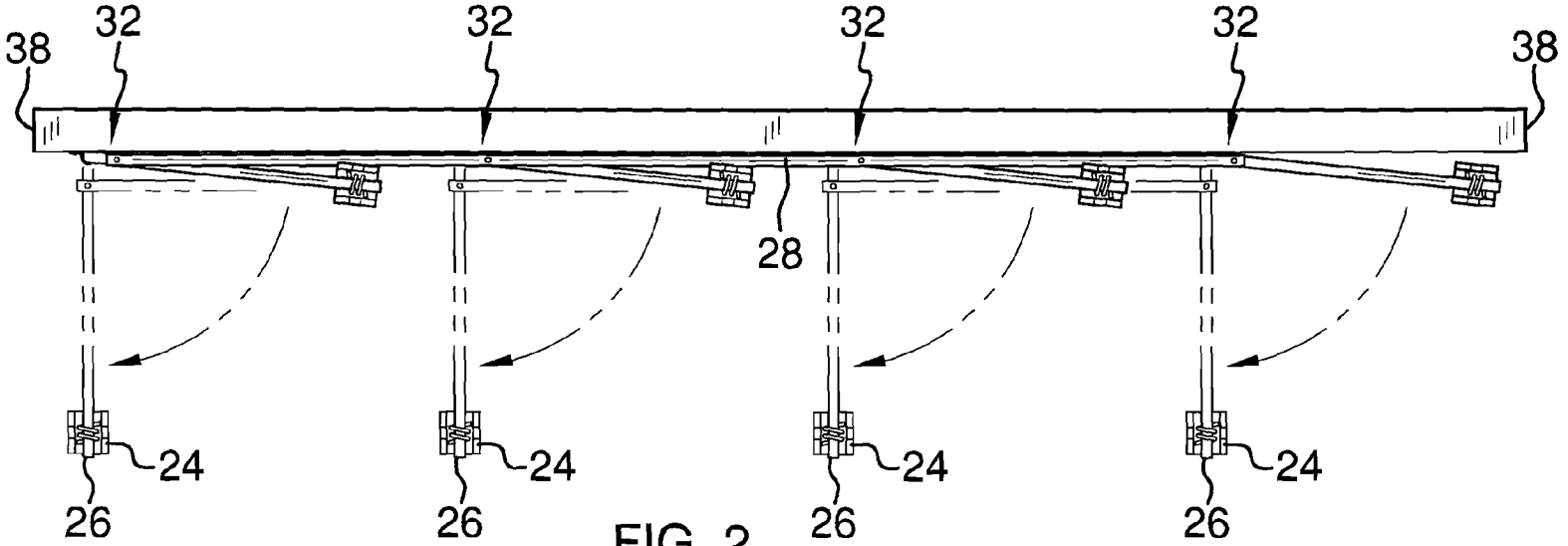
FIG. 2 is a top view of an embodiment of the disclosure.
Figure 3:
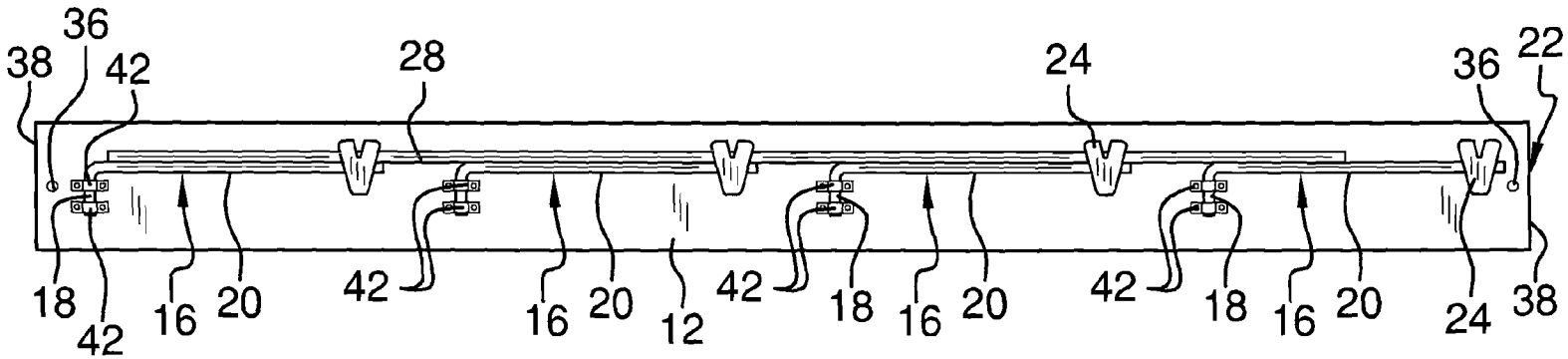
FIG. 3 is a front view of an embodiment of the disclosure.
Figure 4:
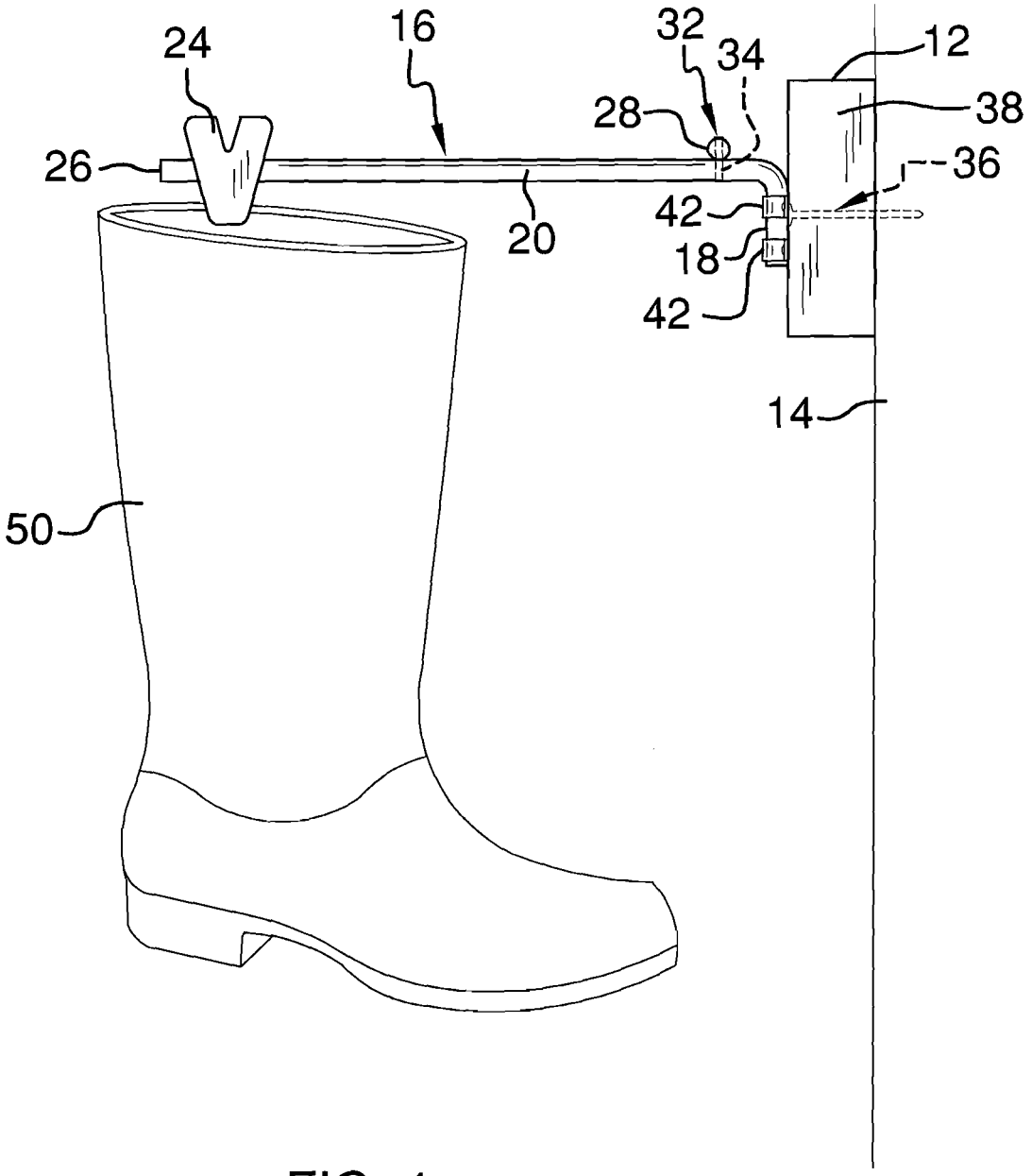
FIG. 4 is a side view of an embodiment of the disclosure in use.

With reference now to the drawings, and in particular to FIGS. 1 through 4 thereof, a new storage device embodying the principles and concepts of an embodiment of the disclosure and generally designated by the reference numeral 10 will be described.

As best illustrated in FIGS. 1 through 4, the compactable wall mounted storage assembly 10 generally comprises a mounting plate 12 configured for being coupled to a support surface 14. A pair of apertures 36 extends through the mounting plate 12 to facilitate coupling of the mounting plate 12 to the support surface 14. Each aperture 36 is positioned adjacent to an associated end 38 of the mounting plate 12.

A plurality of arms 16 are pivotally coupled to the mounting plate 12. Each arm 16 may be L-shaped having a connection portion 18 pivotally coupled to the mounting plate 12 and an extension portion 20 extending transversely from the connection portion 18. Each arm 16 is pivotable into a retracted position 22 parallel to the mounting plate 12. Each arm 16 is further pivotable to extend outwardly from the mounting plate 12. A plurality of brackets 42 may be utilized. Each connection portion 18 of each arm 16 may be coupled to the mounting plate 12 by an associated spaced pair of the brackets 42.

The arms 16 are positioned in spaced relationship to each other along a length of the mounting plate 12 when the arms 16 are in the retracted position 22. Thus, the arms 16 do not overlap each other to facilitate spaced storage of items coupled to the arms 16. A plurality of clips 24 is provided. Each clip 24 is coupled to an associated one of the arms 16 proximate a distal end 26 of the associated arm 16 relative to the mounting plate 12. Each clip 24 is designed to hold an item such as a boot 50 and may be provided with sufficient clip strength to hold a pair of boots using one clip 24.

A connection rod 28 may be pivotally coupled to the extension portion 20 of each of the arms 16 proximate a junction 30 between the extension portion 20 and the connection portion 18. A plurality of spaced holes 32 extend through the connection rod 28. An equal plurality of pins 34 is provided. Each pin 34 is coupled to and extends from an associated one of the arms 16. Each pin 34 further extends through an associated one of the holes 32 in the connection rod 28 whereby the connection rod 28 is pivotally coupled to each of the arms 16. The arms 16 are thus urged to pivot in unison with respect to the mounting plate 12.

The mounting plate 12 may have a length between 90 and 130 centimeters. There may be four arms 16 each having a length between 22 and 26 centimeters. The arms 16 may be spaced between 28 and 32 centimeters apart to provide space between the items being attached to the clips 24.

In use, the mounting plate 12 is coupled to the support surface 14 such as a wall in a closet. The arms 16 are pivoted to extend outwardly from the mounting plate 12 to facilitate access to the clips 24. Items such as the boot 50 are attached to the clips 24 for storage. The arms 16 are then pivoted back towards the retracted position 22 to store the items in a more compact fashion that does not require taking up floor space.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

I claim:

1. A storage assembly comprising:

a mounting plate configured for being coupled to a support surface;

a plurality of arms pivotally coupled to said mounting plate, each said arm being pivotable into a retracted position parallel to said mounting plate, each said arm further being pivotable to extend outwardly from said mounting plate, each said arm being L-shaped;

a plurality of clips, each said clip being coupled to an associated one of said arms proximate a distal end of said associated arm relative to said mounting plate;

each said arm having a connection portion pivotally coupled to said mounting plate and an extension portion extending transversely from said connection portion;

a connection rod pivotally coupled to said extension portion of each of said arms proximate a junction between said extension portion and said connection portion whereby said arms pivot in unison with respect to said mounting plate;

a plurality of spaced holes extending through said connection rod; and a plurality of pins, each said pin being coupled to and extending from an associated one of said arms, each said pin further extending through an associated one of said holes in said connection rod whereby said connection rod is pivotally coupled to each of said arms.

2. The assembly of claim 1, further including said arms being positioned in spaced relationship to each other when said arms are in said retracted position.

3. The assembly of claim 1, further including a pair of apertures extending through said mounting plate whereby said mounting plate is configured for being coupled to the support surface.

4. The assembly of claim 3, further including each said aperture being positioned adjacent to an associated end of said mounting plate.

5. The assembly of claim 1, further including a plurality of brackets, each said connection portion of each said arm being coupled to said mounting plate by an associated spaced pair of said brackets.

6. A storage assembly comprising:

a mounting plate configured for being coupled to a support surface;

a plurality of L-shaped arms pivotally coupled to said mounting plate, each said arm having a connection portion pivotally coupled to said mounting plate and an extension portion extending transversely from said connection portion, each said arm being pivotable into a retracted position parallel to said mounting plate, each said arm further being pivotable to extend outwardly from said mounting plate, said arms being positioned in spaced relationship to each other when said arms are in said retracted position;

a plurality of clips, each said clip being coupled to an associated one of said arms proximate a distal end of said associated arm relative to said mounting plate;

a connection rod pivotally coupled to said extension portion of each of said arms proximate a junction between said extension portion and said connection portion whereby said arms pivot in unison with respect to said mounting plate;

a plurality of spaced holes extending through said connection rod;

a plurality of pins, each said pin being coupled to and extending from an associated one of said arms, each said pin further extending through an associated one of said holes in said connection rod whereby said connection rod is pivotally coupled to each of said arms;

a pair of apertures extending through said mounting plate whereby said mounting plate is configured for being coupled to the support surface, each said aperture being positioned adjacent to an associated end of said mounting plate; and a plurality of brackets, each said connection portion of each said arm being coupled to said mounting plate by an associated spaced pair of said brackets.

* * * * *